United States Patent [19]

Kumbatovic

[11] Patent Number: 4,614,897

[45] Date of Patent: Sep. 30, 1986

[54] SWITCHING CIRCUIT

[75] Inventor: Robert A. Kumbatovic, Bridgewater, N.J.

[73] Assignee: RCA Corporation, Princeton, N.J.

[21] Appl. No.: 609,360

[22] Filed: May 11, 1984

[51] Int. Cl.[4] ..... H05B 37/02

[52] U.S. Cl. ..... 315/224; 307/252 K; 307/252 L; 315/226; 315/307; 315/DIG. 7

[58] Field of Search ..... 307/252 K, 252 L; 315/307, 224, 221, DIG. 7

[56] References Cited

U.S. PATENT DOCUMENTS

| | | | |
|---|---|---|---|
| 2,890,353 | 6/1959 | Van Overbeek et al. | 307/260 |
| 3,034,015 | 5/1962 | Schultz | 315/DIG. 7 |
| 3,278,827 | 10/1966 | Corey et al. | 307/252 |
| 3,453,256 | 3/1969 | Young | 307/252 L |
| 3,510,692 | 5/1970 | Hufford | 307/252 K |
| 3,700,924 | 10/1972 | Fulkerson | 307/255 |
| 3,898,483 | 8/1975 | Sander et al. | 307/238 |
| 3,921,035 | 11/1975 | Holmes | 315/307 |
| 4,071,779 | 1/1978 | Kawanami et al. | 307/255 |
| 4,112,315 | 9/1978 | Ohhinata | 307/252 L |
| 4,221,980 | 9/1980 | Louw et al. | 307/255 |
| 4,415,839 | 11/1983 | Lesea | 315/247 |
| 4,477,748 | 10/1984 | Grubbs | 315/307 |

OTHER PUBLICATIONS

Article, "Solid State Ballasting of Fluorescent and Mercury Lamps", by B. M. Wolfframm, pp. 169–173, from Power Semiconductor Applications, vol. II: Equipment and Systems, IEEE Press.

Article, "Ballasting a Mercury Arc Lamp with a Solid State Circuit", by P. Schiff, Electronics, Aug. 5, 1968, pp. 130–135.

*Primary Examiner*—Harold Dixon

*Attorney, Agent, or Firm*—Joseph S. Tripoli; Henry I. Schanzer

[57] ABSTRACT

An electronic switch is disclosed that uses two complementary regenerative latches connected in a push-pull arrangement. The latches are interconnected so that when either latch turns on, the other latch is forced to turn off. In this arrangement, the inherently short turn-on time of each regenerative latch translates to a shortened turn-off time of the other latch. The switch is disclosed in the context of a fluorescent lamp ballast and dimmer circuit.

17 Claims, 1 Drawing Figure

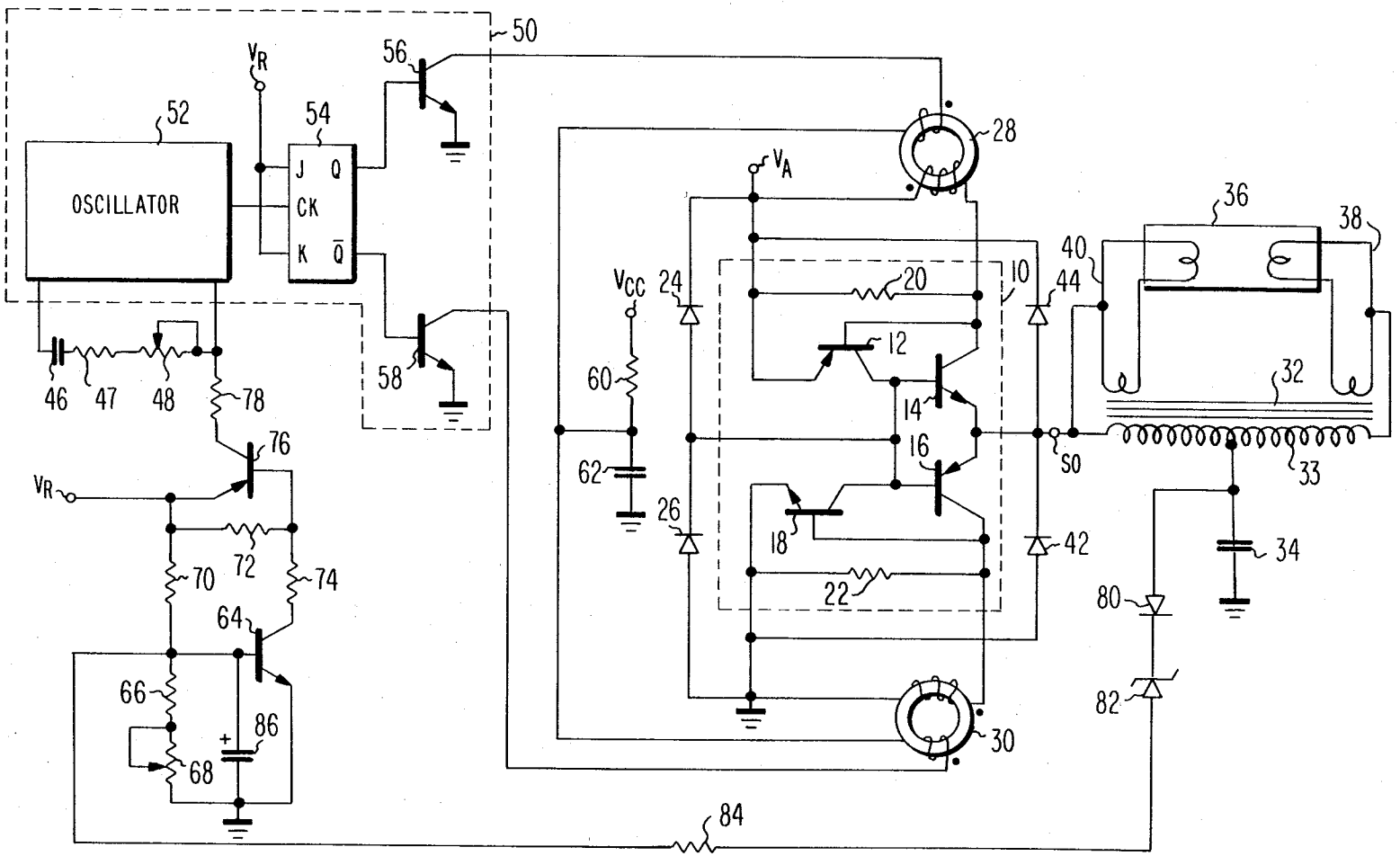
OSCILLATOR
J
Q
CK
K
$\bar{Q}$
$V_A$
$V_{CC}$
$V_R$
$V_R$
SO

SWITCHING CIRCUIT

The present invention relates generally to switching circuits and specifically to current switching circuits used in direct current to alternating current inverters for fluorescent lamp ballasts.

The regenerative latch is a known switching circuit composed essentially of two complementary bipolar transistors, a driver and an output transistor, having interconnected base and collector electrodes. A load is connected to the emitter of the output transistor and power is provided by connections to the other end of the load and the emitter of the driver transistor. The driver transistor receives positive and negative pulses at its base electrode to turn the output transistor on and off respectively. When the output transistor turns on, regenerative feedback from the collector of the output transistor to the base of the driver transistor causes the driver transistor to turn on. As more current flows through the collector of the driver transistor, more base drive is applied to the output transistor causing it to turn on more quickly than it would without the regenerative feedback.

Since both transistors are turned on with a large base drive, they both become saturated making it difficult to turn the latch off. The pulse used to turn off the saturated driver must have a greater magnitude and be sustained for a longer period than the pulse used to turn the driver on. This asymmetry between the turn-on and turn-off pulses can be reduced by degenerating the gain of the driver transistor. Connecting a resistor in parallel with the base-emitter junction of the driver transistor, for example, will reduce the base drive applied to the transistor so that it does not become saturated and thus is more easily turned off.

Even with this improvement, however, the turn-off time of the regenerative latch is greater than its turn-on time because of the accumulated charge in the saturated base-emitter junction of the output transistor. This accumulated charge prolongs current flow from the output transistor even after base potential has been applied to turn the transistor off. As the only current sink to dissipate this current is the load, the turn-off time of the latch is greater if the latch has a high impedance load than if it has a low impedance load.

An improved regenerative latch would include circuitry to drain the stored charge from the base-emitter junction of the output transistor rapidly as the latch is being turned off and so, make its turn-off time independent of its load impedance.

SUMMARY OF THE INVENTION

Accordingly, the present invention is an improved regenerative switching circuit, including two complementary regenerative latches, one providing a positive current and the other a negative current, arranged in a push-pull configuration so that when either latch turns on it drives the other latch to turn off and, at the same time, provides a large current sink to bring the residual current supplied by the other latch quickly to a substantially zero value.

The sole FIGURE is a part schematic and part block diagram of an embodiment of the invention in a fluorescent lamp ballast and dimmer circuit.

When it is operating, a fluorescent lamp is a negative resistance device. An increase in lamp current increases the ionization of the gas, which decreases its impedance and thus decreases the potential appearing across the lamp. In view of this, it is desirable to regulate the current supplied to the lamp by limiting it to a value that causes enough ionization in the gas for adequate fluorescence. Any greater level of current would waste power since it would not provide significantly greater illumination.

Traditionally, current regulation in a fluorescent lamp ballast is provided by an inductor in series with the lamp. When an alternating current is applied across this series combination, a phase shift between the alternating current and its associated potential is obtained so a relatively high potential and low current is available for striking the lamp and a relatively high current and low potential is available for operating the lamp efficiently. The degree of phase shift achieved depends on the reactance of the inductor and the frequency of the alternating current applied to it. A traditional ballast operating at 60 Hz uses a relatively high reactance inductor that is both expensive and bulky compared to the lower reactance inductors that are used in ballasts operating at higher frequencies.

Ballasts operating at higher frequencies are also beneficial because they exhibit less flicker and greater luminance output for a given applied power than 60 Hz ballasts. To operate a ballast from a 120 volt 60 Hz source, but at a frequency significantly higher than 60 Hz, it may be desirable to rectify the 60 Hz alternating current into direct current and then use a direct current to alternating current inverter operating at the higher frequency to derive alternating current for operating the lamp. It is desirable for efficient operation of such an inverter to have it switch rapidly in generating the alternating current to minimize resistive losses in the inverter and, so, provide more power to the lamp.

The circuit in the FIGURE is a fluorescent lamp ballast and dimmer circuit that uses a direct current to alternating current inverter incorporating an electronic switch in accordance with the present invention. The switch 10 consists of two complementary transistor regenerative latches arranged in a push-pull configuration. Transistors 12 and 14 and resistor 20 make up a first latch and transistors 16 and 18 and resistor 22 make up the second latch. The emitter electrode of PNP driver transistor 12 of the first latch is connected to one end of a source of operational supply $V_A$, the other end of which is connected to the emitter electrode of NPN driver transistor 18 of the second latch and to a source of reference potential (e.g. ground).

If the first latch is off and the second latch is on, a negative pulse applied to the base electrode of driver transistor 12 will reverse the state of the switching circuit, turning the first latch on and the second latch off. The negative pulse at the base of PNP driver transistor 12 turns the transistor on, raising the potential applied to the base of NPN output transistor 14 and, so turning it on. When transistor 14 turns on, the potential on its collector falls, increasing the base drive applied to driver transistor 12 causing it to conduct more current, and so regeneratively increasing the base drive of transistor 14.

As the first latch is turning on in response to the negative input signal pulse, the second latch is turning off. When driver transistor 12 is turned on, it conducts current to the base electrode of output transistor 16. This current flow causes the base-emitter junction of output transistor 16 to become reverse biased and so causes transistor 16 to turn off. When this occurs, base drive is removed from driver stage transistor 18 and the second latch is turned off. Since the current flow from driver transistor 12 removes the stored charge from the base-emitter junction of transistor 16 as it turns transistor 16 off, the turn off time of the second latch does not depend on the impedance of the load and, so, is less than the turn off time of a simple regenerative latch.

The turn off time of the second latch can be further shortened by applying a negative pulse to the base of driver transistor 18 at the same time that the negative pulse is applied to the base of transistor 12. This pulse reverse biases the base-emitter junction of driver transistor 18 causing it to be turned off at the same time that current is being supplied by driver transistor 12 to turn off output transistor 16. As driver transistor 18 is turned off, it draws less current from the base electrode of output transistor 16 enabling driver transistor 12 to reverse bias transistor 16 more quickly.

Resistor 22 is coupled between the base and emitter electrodes of driver transistor 18 to degenerate its gain and so decrease the current flow through the emitter-collector path of transistor 18. The decreased current flow through driver transistor 18 to the base electrode of output transistor 16 allows the output transistor to be turned off more quickly than if the driver stage gain were not degenerated, since a smaller current flow from driver transistor 12 is needed to reverse bias output transistor 16.

A positive pulse applied to the base electrodes of the driver transistors 12 and 18 reverses the state of the switching circuit, turning the second latch on and the first latch off. This state transition is the complement of the one just described.

The current provided by the emitters of the two output transistors, connected at switch output terminal SO, is applied to the energy storage circuit that includes transformer 32 and capacitor 34. The primary winding 33 of transformer 32 is connected at one end to terminal SO and to one terminal of the fluorescent lamp 36 and at the other end, to the other terminal of the fluorescent lamp. Transformer 32 has two secondary windings, 38 and 40, each of which is connected to a respectively different one of the two filaments of fluorescent lamp 36. A capacitor 34 is coupled between the center tap of the primary 33 and ground.

When the first latch of switch 10 is turned on, positive current from the emitter electrode of transistor 14 flows into primary winding 33, charging capacitor 34. As the potential across the capacitor approaches the supply potential $V_A$, the magnitude of the current flow from the switch decreases. However, because of the energy stored in the transformer primary, current continues to flow into the capacitor. The potential across the capacitor reaches its most positive value when the current flow in the transformer primary is substantially zero. This value may be greater than the value of the potential provided by supply $V_A$.

As the potential across capacitor 34 reaches its most positive value, switch 10 changes state and tends to conduct in the direction to draw current from and so lower the potential across capacitor 34. When the potential across the capacitor 34 reaches its most negative value, switch 10 again changes state and the capacitor begins to charge.

The current flow through transformer primary 33 induces a current flow in each of the secondary windings 38 and 40 which heat the filaments of fluorescent lamp 36.

As described above, the potential across the primary winding 33 is applied to the two terminals of the fluorescent lamp 36. If supply $V_A$ provides a sufficiently high potential (e.g. 170 v) the potential developed across the transformer primary is sufficient both to strike and to operate the fluorescent lamp.

Ignoring, for the moment diodes 42 and 44; the combination of switch 10, transformer 32, capacitor 34 and diodes 24 and 26 form a free-running oscillator. This oscillator operates at the resonant frequency of the tank circuit formed by capacitor 34 and the inductance of one-half of the primary winding 33 of transformer 32.

To understand how the circuit oscillates, assume that the first latch is turned on, providing a positive current flow from the emitter of transistor 14 to charge capacitor 34. As the capacitor charges, the potential at switch output terminal SO rises. As this potential rises, it reduces the potential across the base-emitter junction of transistor 14 and, thus, reduces the charging current supplied to capacitor 34 by switch 10. The energy stored in the inductance of transformer primary winding 33, however, tends to keep the amplitude of the charging current constant, raising the potential at terminal SO. As the potential at terminal SO becomes greater than potential $V_A$, the base-emitter junction of transistor 14 becomes reverse biased, and transistor 14 turns off. At the same time, the overvoltage potential at terminal SO forward biases the base-emitter junction of transistor 16. Base drive for transistor 16 is provided through diode 24 (this occurs when the overvoltage at terminal SO is more than twice the forward biased junction potential, e.g. 1.4 volts, greater than potential $V_A$). When the overvoltage forward biases the emitter junction of transistor 16, collector current from transistor 16 causes a current to flow through base-emitter junction of transistor 18 forward biasing it and, so, causing the transistor to turn on. When transistor 18 turns on, the second latch turns on and the current flow in the transformer primary collapses, reversing the current flow through terminal SO and discharging the capacitor. As the capacitor discharges, the potential at terminal SO falls to a value below ground potential because of the energy stored in the inductance of transformer primary winding 33. This undervoltage condition acts to turn the second latch off and to turn the first latch on, complementary to the action of the overvoltage condition.

While it is desirable for efficient operation of the fluorescent lamp to have the switch free-run, it is not desirable for dimming the lamp as will be explained below. Consequently, diodes 42 and 44 are included in the circuit to suppress its tendency to free-run. Diode 42 has its anode end connected to ground and its cathode end connected to switch output terminal SO, and diode 44 has its anode end connected to terminal SO and its cathode end connected to the supply $V_A$. When a potential greater than supply potential $V_A$ or less than ground potential tends to occur at terminal SO, it is limited by diodes 44 and 42 to be no more than one junction potential above the supply potential and no lower than one junction potential below ground. Since these potentials are the same as the potentials that would be developed at the junction of the forward conducting diodes 24 and 26, the base-emitter junctions of the output transistors cannot become forward biased. Consequently, the circuit will not operate as a free-running oscillator.

Although the output transistors of the first and second latches cannot be turned on by the overvoltage and undervoltage conditions, they can still be turned off.

When either an overvoltage or an undervoltage condition occurs, the bases and emitters of the two output transistors are all at the same potential. In this state neither of the output transistors is biased for conduction and so both are turned off.

Since the switch does not oscillate, it must be driven to generate high frequency alternating current to operate the lamp. This drive is applied to the switch 10 by pulse transformers 28 and 30. Square wave signals are applied to the primary windings of the two transformers by circuit 50. These induce positive and negative pulses in the secondary windings of the transformers 28 and 30. The secondary winding of pulse transformer 28 is connected between the base and emitter electrodes of driver transistor 12 and wound with respect to the primary winding, to provide positive and negative pulses respectively to the base of transistor 12 in response to the positive going and negative going edges of the square wave signals applied to the primary winding. The secondary winding of pulse transformer 30 is connected between the base and emitter electrodes of driver transistor 18, but it is wound with respect to its primary winding, to provide negative and positive pulses respectively to the base of transistor 18 in response to the positive going and negative going edges of the square wave signals on the primary winding.

The secondary windings of the pulse transformers also act to degenerate the gain of the two driver stages, further reducing the turn off time of the two latches. When a transition in potential occurs on the primary winding, the induced potential across the secondary winding is initially relatively high. This potential falls rapidly, however, since the impedance through the inductive secondary winding decreases with time. As this potential falls, the potential across the base-emitter junction of the driver transistor also falls and the latch —if it was turned on by the first transition—is turned off before the next transition. The pulse transformer secondaries, therefore, are desirably designed to have an inductance large enough to provide a relatively high impedance for each pulse induced by a transition in the square wave signals and yet small enough to provide a relatively low impedance before the next pulse occurs.

The square wave signals applied to the pulse transformer primaries are provided by the circuit 50 that includes oscillator 52, flip-flop 54 and transistors 56 and 58. Oscillator 52 includes as timing elements capacitor 46, resistor 47 and potentiometer 48. Capacitor 46 is connected at one end to one of the feedback inputs of oscillator 52 and at the other end to one end of resistor 47. Potentiometer 48 is connected to the other end of resistor 47 and to the other feedback input of oscillator 52.

The frequency of the signal provided by the oscillator 52 is determined by the resistance and capacitance in its feedback path. Potentiometer 48 is included in the feedback path to allow adjustment of the oscillator frequency for maximum brightness in the lamp. This occurs when the oscillator frequency is adjusted to be approximately twice the resonance frequency of the series tank circuit formed by one-half of transformer primary winding 33 and capacitor 34. The signal produced by the oscillator is applied to the clock input (CK) of JK flip-flop 54. The J and K data inputs to flip-flop 54 are connected to a source of reference potential, $V_R$, substantially equal to a logic high value. In this configuration, the flip-flop is a frequency divider. The signals at the Q and $\overline{Q}$ output terminals of the flip-flop are complementary square wave signals at one-half the oscillator signal frequency.

The Q output terminal of flip-flop 54 is connected to the base electrode of transistor 56 which has its emitter electrode connected to ground and its collector electrode connected to the one end of the primary winding of pulse transformer 28. Similarly, the $\overline{Q}$ output terminal of flip-flop 54 is connected to the base electrode of transistor 58, the emitter and collector electrodes of which are connected to ground and to one end of the primary winding of pulse transformer 30 respectively.

The other end of the primary winding of the pulse transformers 28 and 30 are connected to each other and to resistor 60 and capacitor 62. The other end of resistor 60 is connected to a source of operating potential, $V_{CC}$ (e.g. 25 volts). The other end of the capacitor 62 is connected to ground. Resistor 60 limits the current drawn by transistors 56 and 58. Capacitor 62 is included to lower the effective AC output impedance to supply $V_{CC}$ incurred by the use of limiting resistor 60.

Operationally, signals from the oscillator 52 are applied to trigger the flip-flop 54 to change state, producing two complementary square wave signals at the two outputs of the flip-flop. These signals are inverted and amplified by transistors 56 and 58 and applied to the primary windings of the two pulse transformers 28 and 30. The secondary winding of pulse transformer 28 provides a positive pulse for a positive going edge and a negative pulse for a negative going edge of the square wave signal on the primary winding. The secondary winding of transformer 30, however, inverts the signal applied to its associated primary winding, providing a negative pulse for a positive going edge and a positive pulse for a negative going edge. Accordingly, the input signals to the switch 10 vary between being both positive and both negative. These input signals drive the switch 10 as described above to illuminate the lamp 36.

When the signals driving the switch are at the resonant frequency of the series tank circuit formed by one-half of primary winding 33 and capacitor 34, the inverter formed by the switch and tank circuits operates most efficiently and so, maximum power is available for lighting the lamp 36. As the frequency of the signals driving the switch is decreased, the repetition rate of the inverter decreases and less power is applied to the lamp. So, the lamp 36 can be dimmed by adjustment of potentiometer 48 to decrease the frequency of the signal provided by oscillator 52.

If the lamp 36 were not in the circuit, and if the tank circuit were being operated at its resonant frequency, the potential across the capacitor would become very large exceeding the breakdown potential of the capacitor and causing current flow through the transistors to become excessive. To prevent this condition, protection circuitry is coupled between the capacitor 34 and the oscillator 52. The protection circuit includes a diode detector connected at one end to capacitor 34 and at the other end to a buffer amplifier which regulates the charging current supplied to the timing capacitor 46 of oscillator 52.

The diode detector includes the serially connected diode 80, zener diode 82, resistor 84 and capacitor 86. The buffer amplifier includes the cascade connected common emitter NPN transistor 86 and common emitter PNP transistor 76. The collector electrode of transistor 76 is coupled in the feedback path of oscillator 52 to shunt charging current from, or supply charging current to the timing capacitor 46 of oscillator 52.

When the potential developed across capacitor 34 exceeds the breakdown potential of zener diode 82, diode 80 becomes forward biased and applies a potential to capacitor 86 via resistor 84. As the potential across capacitor 86 increases, transistor 64 conducts more current. When this increased current is drawn through resistor 72, the potential across the base-emitter junction of transistor 72 increases, causing transistor 72 to shunt charging current from timing capacitor 46. When capacitor 46 receives less current, the frequency of the oscillator is decreased away from the resonant frequency of the ballast circuit and, so the maximum potential developed across the capacitor 34 is reduced.

The buffer amplifier of the protection circuit can also be used to supply a controllable steady-state current to the oscillator to govern the dimming of the lamp. Potentiometer 68 acts with series connected resistors 66 and 70 to form an adjustable voltage divider. By adjusting potentiometer 68, the potential across the base-emitter junction of transistor 64 can be varied, changing the amount of charging current shunted from timing capacitor 46 by transistor 76, as described above, to dim the lamp.

The following table lists the values of components that may be used in the illustrative embodiment except for the values of capacitors 46 and 34. These values can be determined by one skilled in the art once a suitable operating frequency is established.

TABLE I

| | |
|---|---|
| Transistors 12 and 16 | 2N5416 |
| Transistors 14 and 18 | 2N6772 |
| Transistor 64 | 2N3904 |
| Transistor 76 | 2N3906 |
| Diodes 24, 26, 42, 44 and 80 | D2201 |
| Resistors 20 and 22 | 22 Ohms |
| Resistor 47 | 910 Ohms |
| Resistor 60 | 300 Ohms |
| Resistors 66, 72 and 74 | 10 Kilohms |
| Resistor 70 | 5.1 Kilohms |
| Resistor 78 | 1 Kilohm |
| Resistor 84 | 68 Kilohms |
| Potentiometer 48 | 2.5 Kilohms, linear taper |
| Potentiometer 68 | 5 Kilohms, linear taper |
| Capacitor 62 | 0.1 Microfarad |
| Capacitor 86 | 5 Microfarads |
| Transformers 28 and 30 | |
| Core | ¾ inch high frequency toroid |
| Primary | 2 turns |
| Secondary | 3 turns |
| Transformer 33 | |
| primary inductance | 1.2 Millihenrys |

The components in the dashed box 50 and the reference voltage source $V_R$ are included in a regulating pulse width modulator integrated circuit type CA 1524 manufactured by RCA Corporation.

What is claimed is:

1. An electronic switching circuit, comprising:

a first latch and a second latch, each latch having an input terminal and an output terminal and including a driver stage and an output stage, the driver stage being responsive to on-state and off-state signals applied to the input terminal for driving the output stage to provide an output current and a substantially zero current respectively at its output terminal, said output and driver stages of each latch being coupled in a regenerative feedback loop for decreasing the off-state to on-state switching time of each latch;

means connecting the output terminal of said first latch and the output terminal of said second latch to a common output terminal, said first latch being connected to provide an output current in one direction between its output terminal and said common output terminal and said second latch being connected to provide an output current between its output terminal and said common output terminal in the opposite direction to said one direction;

means interconnecting the driver stages of the first and second latches for coupling the driver stage of each latch to the output stage of the other latch and driving the output stage of the other latch into a state complementary to the state into which the driver stage drives its associated output stage, thus decreasing the switching time of the circuit; and means for coupling the switching circuit across a source of operating potential.

2. The switching circuit of claim 1 wherein the first latch comprises:

first and second complementary transistors, each having first, second and control electrodes and having a principle conduction path between the first and second electrodes controlled by a potential applied across the first and control electrodes;

means for coupling the control and second electrodes of the first transistor to the second and control electrodes of the second transistor respectively;

gain degeneration means coupled between the control and first electrodes of the first transistor;

means coupling the first electrode of said first transistor to a source of operating potential;

means coupling the control electrode of said first transistor to the input terminal of the first latch; and means coupling the first electrode of said second transistor to the output terminal of the first latch.

3. The switching circuit of claim 2 wherein the gain degenerating network includes a resistor.

4. The switching circuit of claim 3 further comprising:

a first semiconductor diode, coupled between the first and second electrodes of said first transistor and poled to conduct in a direction opposite to said first transistor.

5. The switching circuit of claim 4 further including a pulse transformer having a primary winding coupled to a signal source and a secondary winding having first and second ends coupled to the control and first electrodes of the first transistor respectively for providing input signals to the input terminal of the first latch.

6. A ballast circuit for a fluorescent lamp, comprising:

first and second connectors for coupling the ballast circuit to a fluorescent lamp;

an energy storage circuit, having a resonant frequency, for regulating current flow to the first and second connectors, including:

an inductor having a first terminal coupled to the first connector and a second terminal coupled to the second connector; and a capacitor coupled at one end to the second terminal of the inductor and at the other end to a source of operating potential;

an electronic switching circuit including:

a first latch, having an input terminal and an output terminal and including a driver stage and an output stage, the driver stage being responsive to on-state and off-state signals applied to the input terminal for driving the output stage to provide an output current and a substantially zero current respectively at the output terminal, wherein the driver and output stages are coupled in a regenerative feedback loop for decreasing the off-state to on-state switching time of the first latch;

a second latch, having an input terminal and an output terminal and including a driver stage and an output stage, the driver stage of the second latch being responsive to on-state and off-state signals applied to the input terminal of the second latch for driving the output stage of the second latch to provide an output current, opposite in direction to the output current provided by the first latch, and a substantially zero current respectively at the output terminal of the second latch, wherein the driver and output stages of said second latch are coupled in a regenerative feedback loop for decreasing the off-state to on-state switching time of the second latch;

means coupling the driver stages of the first and second latches so that the driver stage of each latch is further coupled to the output stage of the other latch for driving the output stage of the other latch into a state complementary to the state into which the driver stage drives its associated output stage, thus decreasing the switching time of the circuit; and means, coupling the output terminals of the first and second latches to the first terminal of the inductor for providing current to the energy storage circuit and for providing oscillatory on-state and off-state input signals at the resonant frequency of the energy storage circuit to the electronic switching circuit via the regenerative feedback loops coupling the respective output and driver stages of the first and second latches.

7. The ballast circuit of claim 6 further comprising:

a dimmer circuit including:

means coupled to the energy storage circuit for suppressing the oscillatory on-state and off-state input signals provided by the energy storage circuit to the switching circuit via the regenerative feedback loops of the first and second latches;

an oscillator for providing a signal at a frequency substantially equal to the resonant frequency of the energy storage circuit;

means, coupled to the oscillator, for varying the frequency of the signal provided by the oscillator in response to the setting of a control;

means, coupling the oscillator to the input terminals of the first and second latches for driving the switching circuit at the oscillator frequency.

8. The ballast circuit of claim 6, wherein the first latch comprises:

first and second complementary transistors, each having first, second and control electrodes and having a principle conduction path through the first and second electrodes controlled by a potential applied across the first and control electrodes;

means for coupling the control and second electrodes of the first transistor to the second and control electrodes of the second transistor respectively;

gain degeneration means coupled between the control and first electrodes of the first transistor;

means coupling the first electrode of said first transistor to a source of operating potential;

means coupling the control electrode of said first transistor to the input terminal of the first latch; and means coupling the first electrode of said second transistor to the output terminal of the first latch.

9. The ballast circuit of claim 8 wherein the gain degeneration means includes a resistor.

10. The ballast circuit of claim 9 further comprising:

a first semiconductor diode, coupled between the first and second electrodes of said first transistor and poled to conduct in a direction opposite to said first transistor.

11. The ballast circuit of claim 10 further including a pulse transformer having a primary winding coupled to a signal source and a secondary winding having first and second ends coupled to the control and first electrodes of the first transistor respectively for providing input signals to the input terminal of the first latch.

12. The ballast circuit of claim 11 further comprising:

a dimmer circuit including:

a third semiconductor diode, coupled between the first electrode of said first transistor and the first electrode of said second transistor and poled to conduct in a direction opposite to said second transistor, for suppressing the oscillatory on-state and off-state input signals provided by the energy storage circuit to the switching circuit via the feedback loop of the first latch;

an oscillator for providing a signal at a frequency substantially equal to the resonant frequency of the energy storage circuit;

means, coupled to the oscillator, for varying the frequency of the signal provided by the oscillator in response to the setting of a control;

means, coupling the oscillator to the input terminals of the first and second latches for driving the switching circuit at the oscillator frequency.

13. The combination comprising:

first and second terminals for the application therebetween of an operating potential;

an output terminal;

a first regenerative latch circuit connected between said first power terminal and said output terminal for supplying a first current to said output terminal in one direction;

a second regenerative latch circuit connected between said output terminal and said second power terminal for supplying a second current to said output terminal in the opposite direction to said first current;

said first latch including first and second transistors of first and second conductivity type respectively, and said second latch including third and fourth transistors of said first and second conductivity type respectively;

each one of said first, second, third and fourth transistors having first and second electrodes defining the ends of a conduction path and a control electrode for controlling the conductivity of said conduction path; each transistor being characterized in that the voltage at its control electrode must exceed the voltage at its first electrode by a threshold voltage for conduction to occur between said first and second electrodes;

means connecting the first electrode of said first transistor to said first power terminal;

means connecting the control electrode of said first transistor and the second electrode of said second transistor to a first circuit node;

means connecting the first electrode of said second and third transistors to said output terminal;

means connecting the second electrode of the third transistor and the control electrode of the fourth transistor to a second circuit node;

means connecting the first electrode of said fourth transistor to said second power terminal; and means connecting the second electrode of said first and fourth transistors in common with the control electrodes of said second and third transistors for turning-off said third transistor when said second transistor is turned-on and for turning-off said second transistor when said third transistor is turned-on.

14. The combination as claimed in claim 13 wherein said first, second, third and fourth transistors are bipolar transistors, each transistor having an emitter, a collector and a base.

15. The combination as claimed in claim 13 wherein said first electrode is an emitter, said second electrode is a collector and said control electrode is a base.

16. The combination as claimed in claim 13 further including first reactive means connected between the first circuit node and said first power terminal; and a second reactive means connected between said second circuit node and said second power terminal.

17. The combination as claimed in claim 13 further including a reactive network connected to said output terminal responsive to an energizing signal for, subsequently, cyclically drawing a current out of said output terminal and supplying a current to said output terminal.

* * * * *